US006360912B1

(12) United States Patent
Lee

(10) Patent No.: US 6,360,912 B1
(45) Date of Patent: Mar. 26, 2002

(54) STRAW HAVING VALVE FUNCTION

(76) Inventor: Kyou Sang Lee, T-406 Minyung Apt., Echon 2-dong, Yongsan-gu Seoul (KR)

( * ) Notice: Subject to any disclaimer, the term of this patent is extended or adjusted under 35 U.S.C. 154(b) by 0 days.

(21) Appl. No.: 09/651,239

(22) Filed: Aug. 30, 2000

(30) Foreign Application Priority Data

Jul. 27, 2000 (KR) ..... 2000-43291

(51) Int. Cl.[7] ..... A47G 19/22

(52) U.S. Cl. ..... 220/705; 229/103.1; 215/388; 239/33; 220/710

(58) Field of Search ..... 220/703, 705, 220/710; 239/33; 215/355, 358, 388

(56) References Cited

U.S. PATENT DOCUMENTS 5,201,460 A * 4/1993 Caines ..... 220/705
5,253,779 A * 10/1993 Lee ..... 220/705
5,353,983 A * 10/1994 Miller ..... 220/705
6,073,860 A * 6/2000 Coppock ..... 220/705
6,116,446 A * 9/2000 Haughton et al. ..... 220/705

* cited by examiner

*Primary Examiner*—Joseph M. Moy
(74) *Attorney, Agent, or Firm*—Kinney & Lange, P.A.

(57) ABSTRACT

A straw including a straw body defined therein with a passage extending throughout the length of the straw body, a bellows portion formed at a desired portion of the straw body, the bellows portion having a desired length, and a tube arranged in the bellows portion and integrally formed with the bellows portion, the tube having a desired elasticity and being configured in such a fashion that opposite inner surface portions thereof are in close contact with each other in a bent state of the bellows portion by a desired angle, thereby closing the passage of the straw body. The straw not only has a function capable of allowing the user to easily adjust the orientation of the straw, thereby easily adjusting the spouting direction of the straw upon drinking the beverage, but also has a valve function for selectively opening and closing the straw, as desired, thereby being capable of adjusting the flow rate of the beverage being spouted through the straw while keeping the taste and aroma of the beverage, preventing foreign matters from being introduced into the container, and preventing the beverage from being unintentionally spouted from the container due to an impact applied to the container.

6 Claims, 8 Drawing Sheets

STRAW HAVING VALVE FUNCTION

BACKGROUND OF THE INVENTION

1. Field of the Invention

The present invention relates to a straw having a valve function, and more particularly to a straw adapted to allow the user to easily and conveniently drink beverage out of a container, which straw not only has a function capable of allowing the user to easily adjust the orientation of the straw, thereby easily adjusting the spouting direction of the straw upon drinking the beverage, but also has a valve function for selectively opening and closing the straw, as desired, thereby being capable of adjusting the flow rate of the beverage being spouted through the straw while keeping the taste and aroma of the beverage, preventing foreign matters from being introduced into the container, and preventing the beverage from being unintentionally spouted from the container due to an impact applied to the container.

2. Description of the Related Art

As well known, there are several problems involved when a person drinks beverage out of a container such as a cup, a package, or a metal can. For example, the drinker may drink an excessive amount of beverage at a draft, so that he may throw up the drunk beverage in a severe case. Also, the drinker may carelessly drop the container, thereby resulting in a spillage of the beverage from the container. In order to solve such problems, a bar-shaped straw has been used, which is adapted to allow the user to easily and conveniently drink a desired amount of a beverage contained in a container.

Typically, such a straw is configured to have a hollow rod shape having a passage extending throughout the straw, as shown in FIG. 1*a*. Since the straw, which is denoted by the reference numeral 10, extends straight, the user can drink a beverage contained in a container only in a state in which the drinker's mouth is vertically aligned with the container. For this reason, it is very inconvenient for the user to drink the beverage using the straw. Furthermore, there is a problem in that the straw may damage the skin of the throat or mouth.

In order to solve the above-mentioned problems, a straw has recently been developed, which has a configuration as shown in FIG. 1*b*. Referring to FIG. 1*b*, a straw 20 is illustrated, which is provided at a substantially central portion thereof with bellows 22 to adjust the orientation of the straw 20, thereby adjusting the spouting direction of the straw 20.

Although each of the above mentioned conventional straws 10 and 20 provides an effect capable of allowing the user to drink in a stabilized way a desired amount of a beverage contained in a container, it still has a problem in that the container has an outlet having a size considerably larger than that of the straw, so that a gap is defined between the outlet and the straw, thereby resulting in a spillage of the beverage from the container through the gap when the user carelessly drops the container. In addition, there is an inconvenience in using the straw in that the drinker must hold the straw by the hand during drinking because the straw is likely to float.

Furthermore, since the passage of the straw is always in an open state, the beverage contained in the container may be unintentionally spouted from the container through the open passage of the straw due to an impact possibly applied to the container when the drinker drinks the beverage using the straw while walking or riding in a car. In this case, the drinker's clothes may be contaminated by the spouted beverage. In addition, there is a problem in that the beverage contained in the container may be contaminated by foreign matters, such as dust, possibly introduced into the container through the gap between the outlet and the straw.

Meanwhile, containers, each of which contains a beverage therein, may typically have a metal can configuration as shown in FIG. 2*a*. Referring to FIG. 2*a*, a metal can 30 is illustrated, which includes a cylindrical body 32, and a can end 34 mounted to the top of the cylindrical body 32 and attached with a tap 36 at the upper surface thereof. However, such a metal can has a problem in that where the drinker does not drink the beverage for a lengthened period of time after detaching the tap from the metal can to drink the beverage, the beverage cannot keep the taste and aroma thereof unless the opening of the metal can formed by the detachment of the tap is maintained in a closed state. In particular, where the beverage contained in the metal can is a carbonated beverage, such a phenomenon may be more severely exhibited. Moreover, there is a problem in that foreign matters may be introduced into the metal can through the opening. In addition, a spillage of the beverage from the container may occur when the drinker carelessly drops the container.

In order to use a straw for an easy and convenient drinking of a beverage contained in a container, the drinker should always carry the straw. However, this is inconvenient. In this regard, a container attached with a separate straw has been proposed. For instance, a package has been commercially available, which is illustrated in FIG. 2*b*. Referring to FIG. 2*b*, the package denoted by the reference numeral 40 is attached with a straw 42 at the side surface thereof. However, the attachment of the straw to the package results in an increase in the number of processing steps in the manufacture of the package, thereby increasing the manufacturing costs. This configuration also involves an inconvenience in use in that the straw should be detached from the package upon using it. In addition, an increased amount of waste is generated.

SUMMARY OF THE INVENTION

Therefore, the present invention has been made in view of the above mentioned problems, and an object of the invention is to provide a straw which is mounted to a beverage container and adapted to allow the user to easily and conveniently drink beverage contained in a container, the straw not only having a function capable of allowing the user to easily adjust the orientation of the straw, thereby easily adjusting the spouting direction of the straw upon drinking the beverage, but also having a valve function for selectively opening and closing the straw, as desired, thereby being capable of adjusting the flow rate of the beverage being spouted through the straw while keeping the taste and aroma of the beverage, preventing foreign matters from being introduced into the container, and preventing the beverage from being unintentionally spouted from the container due to an impact applied to the container.

In accordance with the present invention, this object is accomplished by providing A straw comprising a straw body defined therein with a passage extending throughout the length of the straw body, and a bellows portion formed at a desired portion of the straw body, the bellows portion having a desired length, further comprising: a tube arranged in the bellows portion and integrally formed with the bellows portion, the tube having a desired elasticity and being configured in such a fashion that opposite inner surface portions thereof are in close contact with each other in a bent state of the bellows portion by a desired angle, thereby closing the passage of the straw body, whereby the straw has a valve function provided by the tube.

The straw may further comprise a coupling member provided at a lower portion of the straw body below the bellows portion and mounted to the top of a beverage container, thereby coupling the straw body to the beverage container, and a holding member mounted to a desired portion of the beverage container and adapted to hold an upper portion of the straw body above the bellows portion in the bent state of the bellows portion.

Preferably, the coupling member comprises a coupling member body, a coupling ring formed at an upper portion of the coupling member body and fitted around an outer surface of the straw body, and an annular coupling plate formed integrally with the coupling ring in such a fashion that it extends radially outwardly from a lower end of the coupling ring, the coupling plate being coupled to the top of the container.

The holding member preferably comprises a ring mounted to a desired portion of the beverage container and adapted to fit therein the upper portion of the straw body.

Alternatively, the holding member may comprise a fixing portion mounted to the beverage container, and a pair of spaced engagement hooks integrally formed with the fixing portion, the engagement hooks defining therebetween a gap, through which the upper portion of the straw body can be inserted, and engaging with the inserted portion of the straw body.

The straw body may have a circular or polygonal cross-sectional shape.

The straw having a valve function according to the present invention prevents degradation in the taste of beverage contained in a container, to which the straw is applied, even when the user does not drink the beverage for a lengthened period of time after opening the container to drink the beverage. This is because it is possible to prevent aroma or carbonic acid gas from being outwardly discharged from the container through the straw. The straw of the present invention also prevents an introduction of foreign matters into the container and an unintentional spouting of the beverage from the container resulting in a possible contamination of the the user's clothes. Where the straw is configured to be mounted to the beverage container in accordance with the present invention, there is a convenience in that the user can easily and conveniently drink the beverage without having to carry a straw separately.

BRIEF DESCRIPTION OF THE DRAWINGS

The above objects, and other features and advantages of the present invention will become more apparent after a reading of the following detailed description when taken in conjunction with the drawings, in which:

FIG. 4*b* is an enlarged perspective view corresponding to a portion A of FIG. 4*a.

DESCRIPTION OF THE PREFERRED EMBODIMENTS

Now, preferred embodiments of the present invention will be described in detail, with reference to the annexed drawings.

Figure 1A:
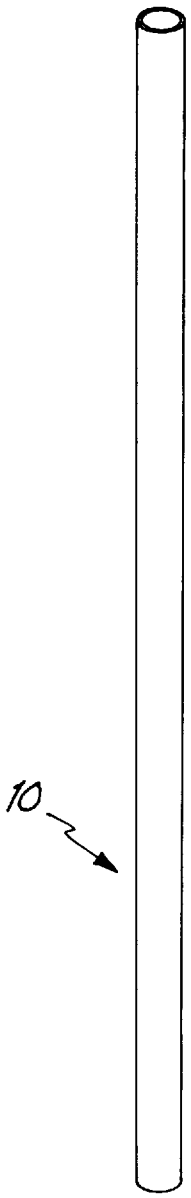
FIG. 1a PRIOR ART
FIG. 1*a* is a perspective view illustrating a conventional straw having a general configuration.
Figure 1B:
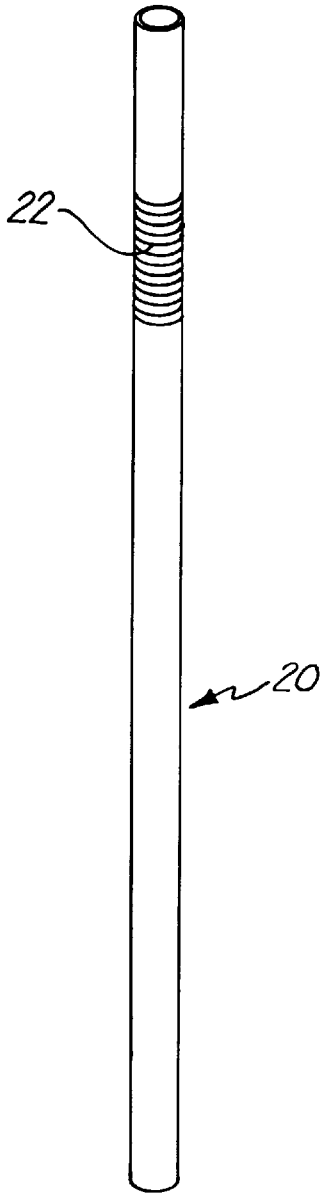
FIG. 1b PRIOR ART
FIG. 1*b* is a perspective view illustrating a conventional straw having a bellows portion.
Figure 2A:
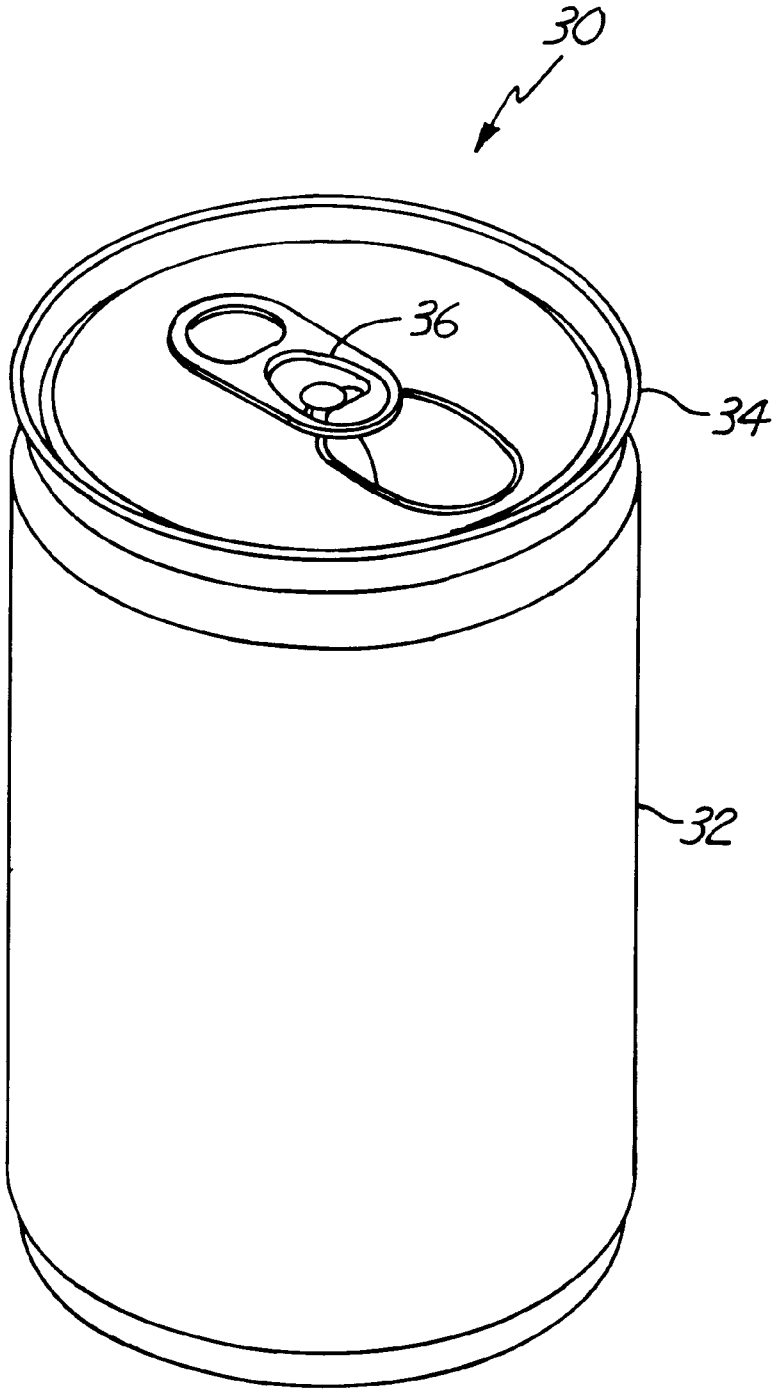
FIG. 2a PRIOR ART
FIG. 2*a* is a perspective view illustrating a metal can having a general configuration.
Figure 2B:
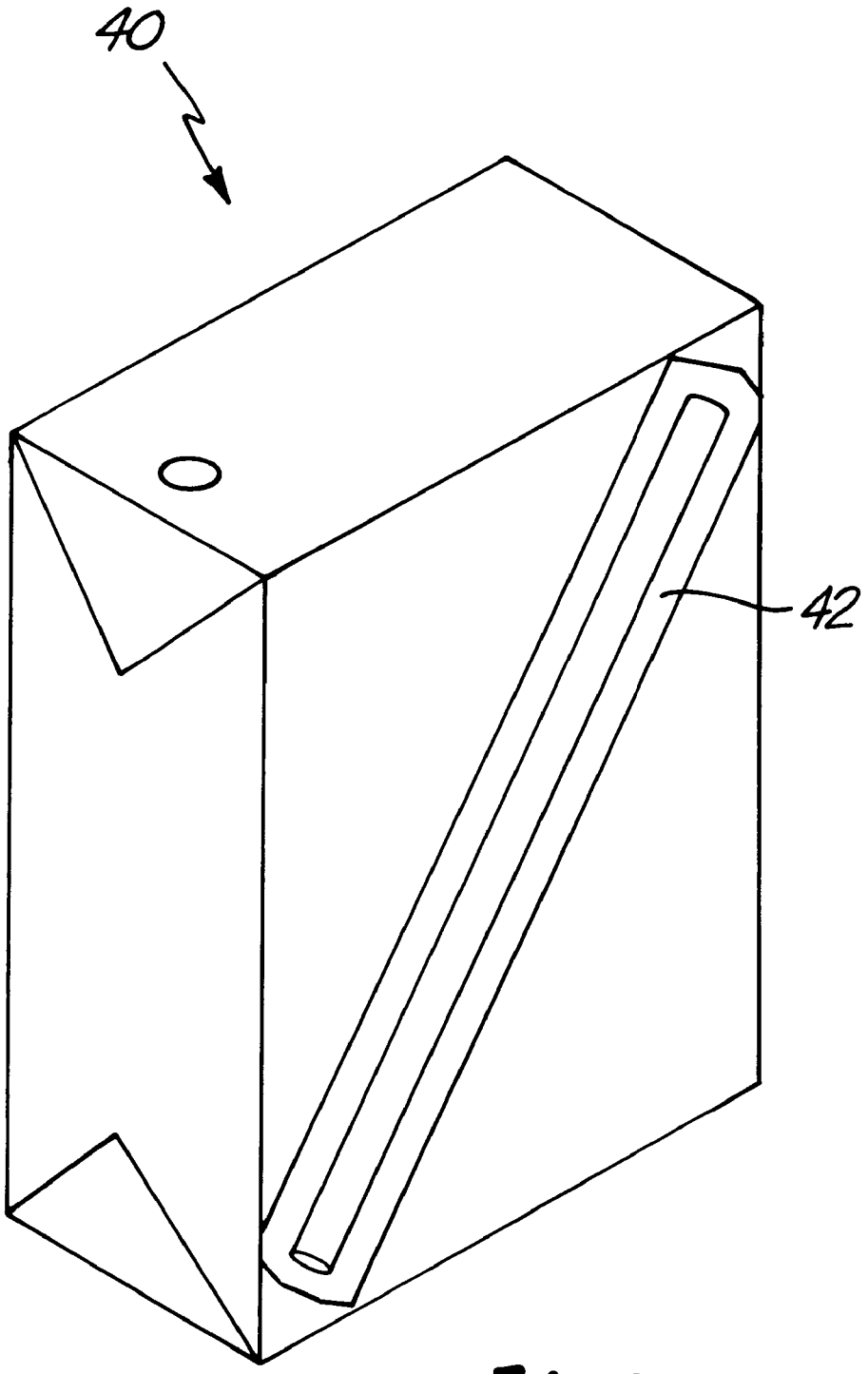
FIG. 2b PRIOR ART
FIG. 2*b* is a perspective view illustrating a beverage container attached with a straw.
Figure 3A:
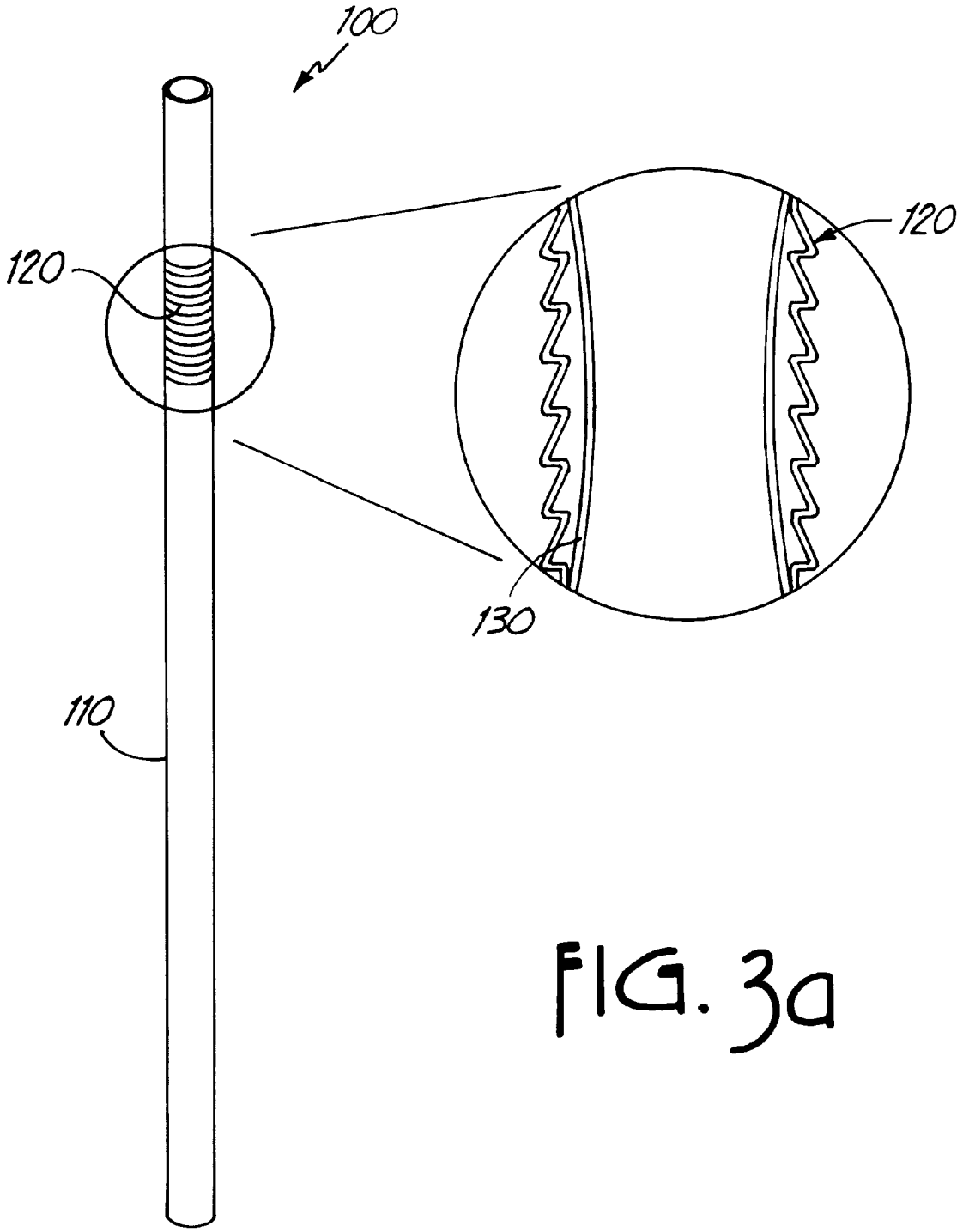
FIG. 3*a* is a perspective view illustrating a straw having a valve function, which is configured in accordance with the first embodiment of the present invention.
Figure 3B:
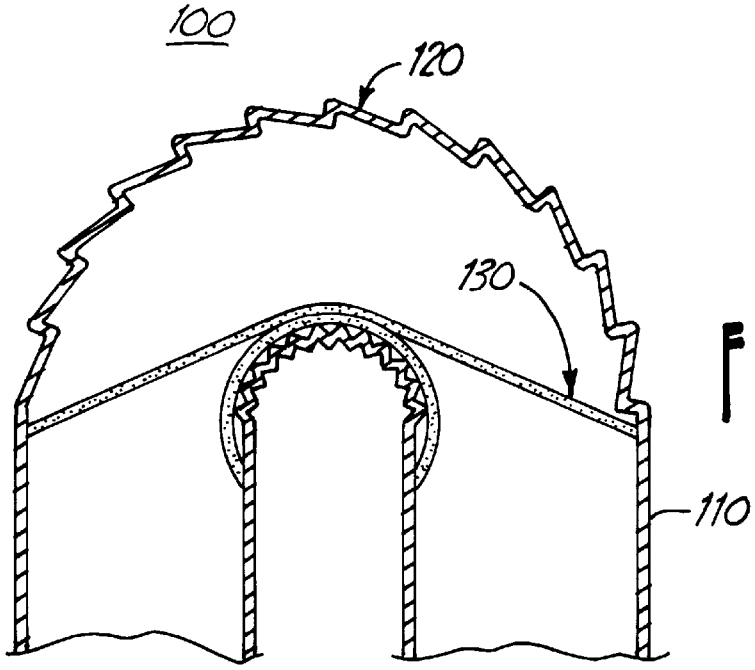
FIGS. 3*b* and 3*c* are sectional views respectively illustrating the straw of FIG. 3*a* which is in a valve-closed state.
Figure 3C:
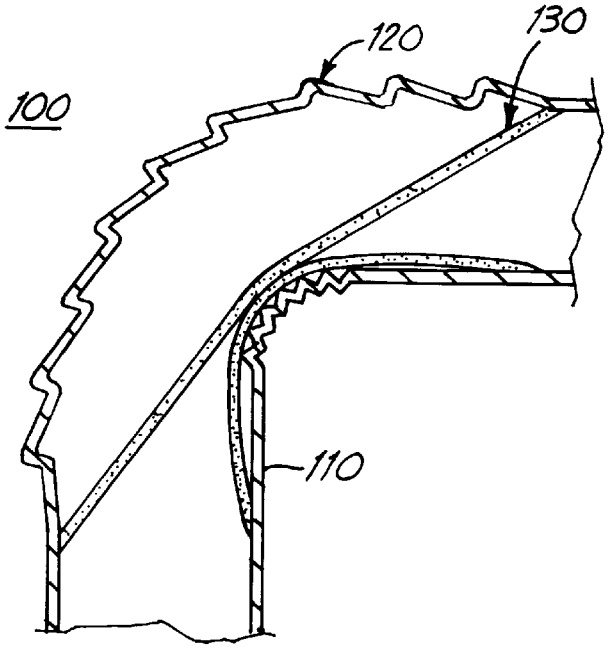
Figure 3D:
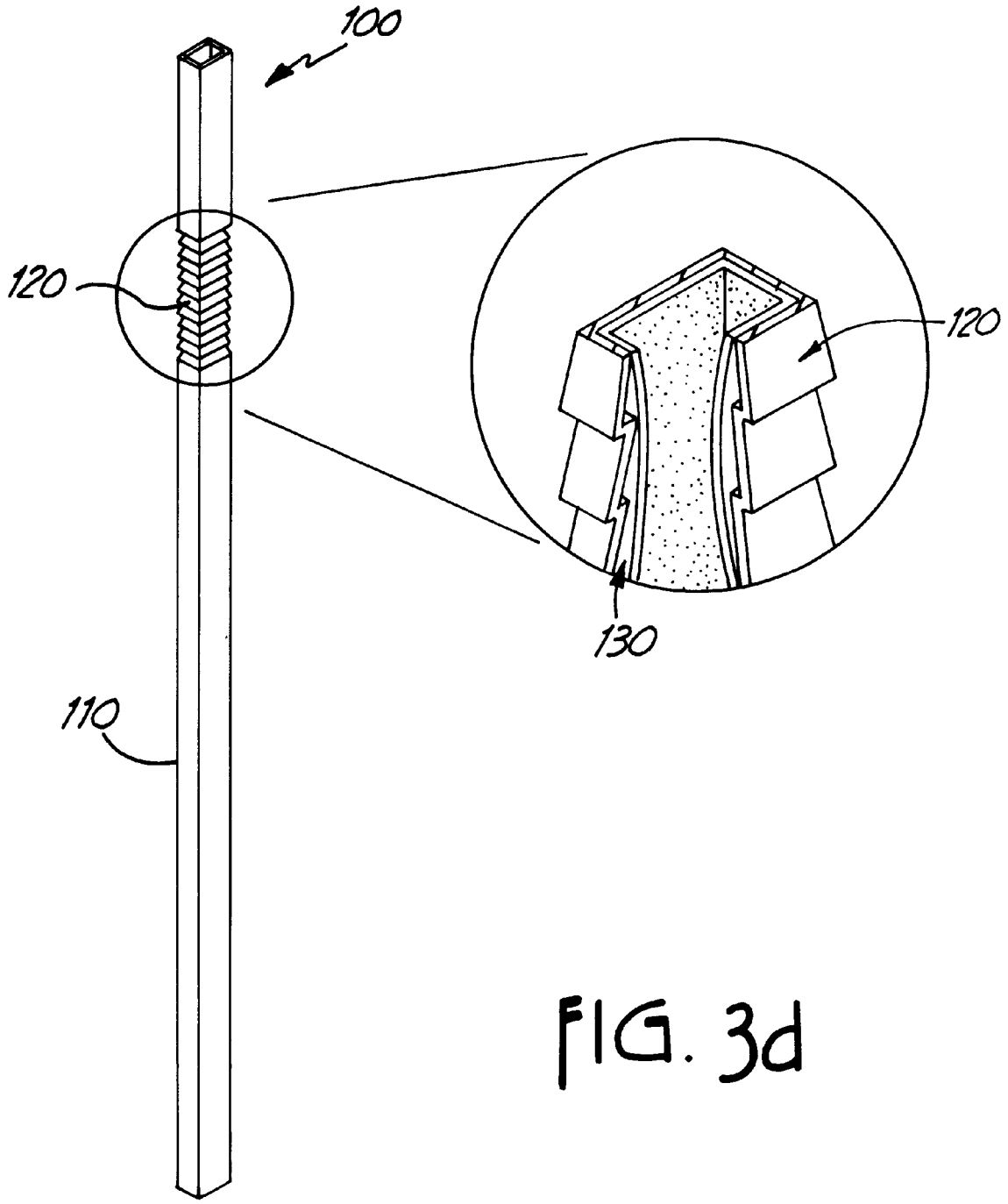
FIG. 3*d* is a perspective view illustrating a straw having a configuration modified from the straw according to the first embodiment of the present invention.

FIG. 3*a* is a perspective view illustrating a straw having a valve function, which is configured in accordance with the first embodiment of the present invention. FIGS. 3*b* and 3*c* are sectional views respectively illustrating the straw of FIG. 3*a* which is in a valve-closed state. FIG. 3*d* is a perspective view illustrating a straw having a configuration modified from the straw according to the first embodiment of the present invention.

As shown in FIGS. 3*a* to 3*c,* the straw denoted by the reference numeral 100 includes a hollow straw body 110 having an elongated rod shape, a bellows portion 120 formed at a desired portion of the straw body 110 while having a desired length, and a tube 130 arranged in the bellows portion 120 and connected at both ends thereof to portions of the straw body 110 respectively arranged beyond both ends of the bellows portion 120.

The bellows portion 120 has a connected structure of alternating crests and valleys. The tube 130 has a desired elasticity. The elasticity of the tube 130 may be obtained by appropriately determining the thickness and material of the tube 130.

In the case of FIG. 3*a,* the cross-sectional shapes of the straw body 110, bellows portion 120 and tube 130 are circular. However, these cross-sectional shapes may be square or rectangular, as in the modified case of FIG. 3*d.* In addition, those elements may be formed to have various shapes, such as polygonal or oval shapes, within the scope of the present invention.

Figure 4A:
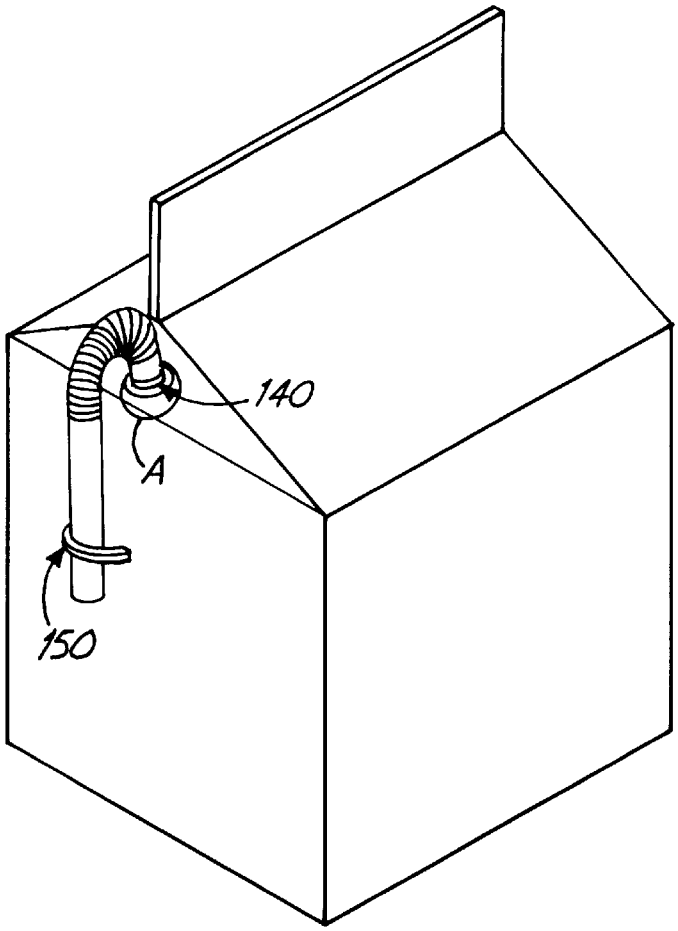
FIG. 4*a* is a perspective view illustrating a straw having a valve function, which is configured to be mounted to a container in accordance with the second embodiment of the present invention.
Figure 4B:
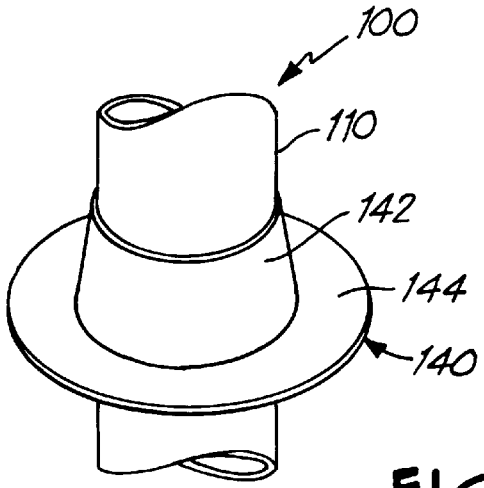
Figure 5:
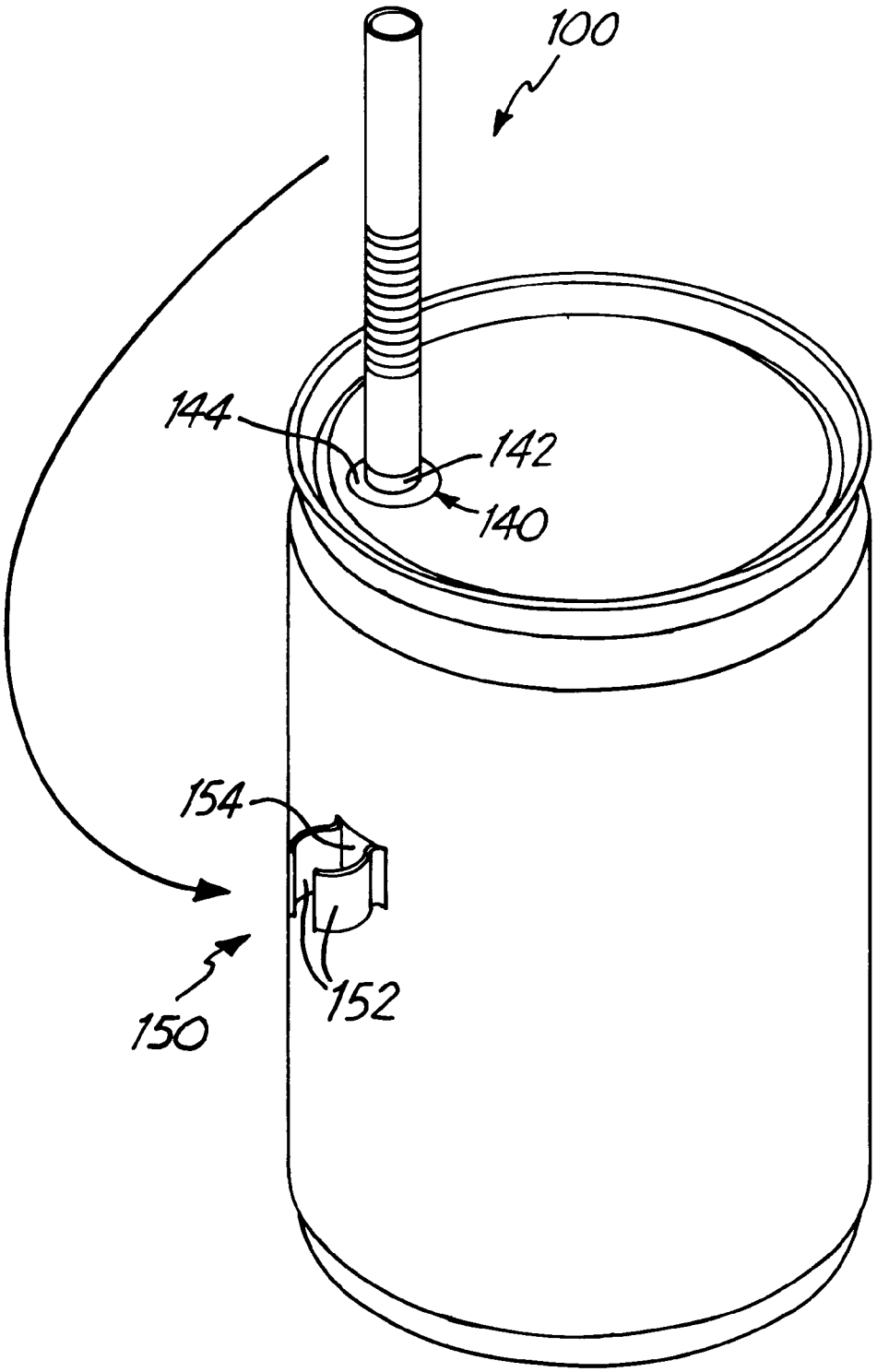
* and FIG. 5 is a perspective view illustrating a straw having a configuration modified from the straw according to the second embodiment of the present invention, in terms of a holding member.

FIG. 4*a* is a perspective view illustrating a straw having a valve function, which is configured to be mounted to a container in accordance with the second embodiment of the present invention. FIG. 4*b* is an enlarged perspective view illustrating the straw of FIG. 4*a.* FIG. 5 is a perspective view illustrating a straw having a configuration modified from the straw according to the second embodiment of the present invention, in terms of a holding member. In FIGS. 4*a,* 4*b,* and 4*c,* elements respectively corresponding to those in FIGS. 3*a* to 3*d* are denoted by the same reference numerals.

As shown in FIGS. 4*a* and 4*b,* the straw according to the second embodiment, which is denoted by the reference numeral 100, includes a hollow straw body 110 having an elongated rod shape, a bellows portion 120 formed at a desired portion of the straw body 110 while having a desired length, and a tube 130 arranged in the bellows portion 120 and connected at both ends thereof to portions of the straw body 110 respectively arranged beyond both ends of the bellows portion 120. The straw 100 also includes a coupling member 140 formed at the outer surface of the straw body 110 below the bellows portion 120 and mounted to the top of a beverage container so as to couple the straw body 110 to the beverage container, and a holding member 150 mounted to a desired portion of the beverage container and adapted to hold an upper portion of the straw body 110 extending from the top of the beverage container in a bent state of the bellows portion 120 in which opposite inner surface portions of the tube 130 are in close contact with each other.

As shown in FIG. 4*b,* the coupling member 140 is provided at an upper portion thereof with a coupling ring 142 formed to have a substantially conical shape and fitted around the outer surface of the straw body 110. The coupling member 140 is also provided with an annular coupling plate 144 formed integrally with the coupling ring 142 in such a fashion that it extends radially outwardly from the lower end of the coupling ring 142. The coupling member 140 having the above mentioned structure may be formed integrally with the straw body 110 in the process of forming the straw body 110 or separately from the straw body 110.

The holding member 150 comprises a ring mounted to a desired portion of the beverage container and adapted to fit therein the upper portion of the straw body 110.

FIG. 5 illustrates a modified configuration of the holding member 150 according to the present invention. As shown in FIG. 5, the holding member 150 has a fixing portion 152 mounted to the beverage container, and a pair of spaced engagement hooks 154 integrally formed with the fixing portion 152 while defining therebetween a gap into which the upper portion of the straw body 110 can selectively be inserted. When the upper portion of the straw body 110 is inserted into the gap between the engagement hooks 154, it is engaged with the engagement hooks 154.

Respective configurations and shapes of the coupling member 140 and holding member 150 may be varied within the scope of the present invention without being limited to those described above. For example, the holding member comprises a ring-shaped member adapted to be fitted around the bellows portion 120 being in a bent state, thereby maintaining the bellows portion 120 in the bent state.

Now, respective operations of the straws according to the first and second embodiments of the present invention will be described in detail.

In the case of the straw of FIGS. 3*a* to 3*c* according to the first embodiment of the present invention, when the user applies a sucking force to the upper end of the straw in a state in which the lower end of the straw has been inserted into a container filled with beverage, this beverage is sucked into the user's mouth via the straw. Where the user subsequently desires to complete the drinking of the beverage, he bends the bellows portion 120 of the straw. As the bellows portion 120 is bent by an angle of 180°, as shown in FIG. 3*b* or by an angle of 90°, as shown in FIG. 3*c,* the tube 130 arranged within the bellows portion 120 is also bent in such a fashion that opposite inner surfaces thereof come into close contact with each other, thereby causing the passage of the straw to be closed. As a result, it is possible for the beverage from flowing through the passage of the straw. Thus, no beverage is outwardly discharged from the container.

In the case of the straw of FIGS. 4*a* and 4*b* according to the second embodiment of the present invention, it is coupled at the lower portion thereof by means of the coupling member 140 coupled to a container contained with a beverage while being held at the upper portion thereof by the holding member 150, so that the straw is initially maintained in a state in which the bellows portion 120 thereof is bent to close the straw passage. When the user desires to drink the beverage contained in the container using the straw in the above-mentioned state, he first separates the upper portion of the straw from the holding member 150, and then upwardly pivots the upper portion of the straw about the bellows portion 120. As a result, the opposite inner surfaces of the tube 130 are spaced away from each other, thereby opening the passage of the straw. When the user applies a sucking force to the upper end of the straw in the above mentioned state, the beverage contained in the container is sucked into the user's mouth via the straw.

Where the drinker subsequently desires to complete the drinking of the beverage, he downwardly pivots the upper portion of the straw about the bellows portion 120, thereby causing the bellows portion 120 to be bent. As the bellows portion 120 is bent, the tube 130 arranged within the bellows portion 120 is also bent in such a fashion that opposite inner surfaces thereof come into close contact with each other, thereby causing the passage of the straw to be closed. As a result, it is possible for the beverage from flowing through the passage of the straw. Thus, no beverage is outwardly discharged from the container. When the drinker desires not to drink the beverage for a lengthened period of time, he fits again the upper portion of the straw in the holding member 150 in order to keep the passage of the straw in a state closed by the tube 130. As a result, the beverage keeps the taste and aroma thereof. In particular, where the beverage is a carbonated beverage, such effect may be more remarkably exhibited in that no carbonic acid gas is outwardly discharged. Furthermore, it is possible to prevent foreign matters from being introduced into the container through the straw. In addition, spillage of the beverage from the container can be prevented even though an impact is applied to the container when the drinker drinks the beverage while walking or riding in a car. Accordingly, it is not likely that the drinker's clothes be contaminated due to spillage of the beverage.

Similarly, in the case of the straw of FIG. 5 having the hook-shaped holding member 150 mounted to a beverage container, the user can drink a beverage contained in the container after separating the upper portion of the straw body 110 from the holding member 150 through a gap defined between the engagement hooks 152. In this case, when he engages again the upper portion of the straw with the hooks 152 of the holding member 150, the passage of the straw is closed again, so that the beverage keeps the taste and aroma thereof. In particular, where the beverage is a carbonated beverage, such effect may be more remarkably exhibited in that no carbonic acid gas is outwardly discharged. Furthermore, it is possible to prevent foreign matters from being introduced into the container through the gap between the outlet and the straw. In addition, spillage of the beverage from the container can be prevented even though an impact is applied to the container.

As apparent from the above description, the straw having a valve function according to the present invention prevents degradation in the taste of a beverage contained in a container, to which the straw is applied, even when the user does not drink the beverage for a lengthened period of time after opening the container to drink the beverage. This is because it is possible to prevent aroma or carbonic acid gas from being outwardly discharged from the container through the straw. The straw of the present invention also prevents introduction of foreign matters into the container and an unintentional spouting of the beverage from the container resulting in a possible contamination of the user's clothes. Where the straw is configured to be mounted to the beverage container in accordance with the present invention, there is a convenience in that the user can easily and conveniently drink the beverage without having to carry a straw separately.

Although the preferred embodiments of the invention have been disclosed for illustrative purposes, those skilled in the art will appreciate that various modifications, additions and substitutions are possible, without departing from the scope of the invention as disclosed in the accompanying claims.

What is claimed is:

1. A straw comprising a straw body defined therein with a passage extending throughout the length of the straw body, and a bellows portion formed at a desired portion of the straw body, the bellows portion having a desired length, further comprising:

a tube arranged in the bellows portion and integrally formed with the bellows portion, the tube having a desired elasticity and being configured in such a fashion that opposite inner surface portions thereof are in close contact with each other in a bent state of the bellows portion by a desired angle, thereby closing the passage of the straw body, whereby the straw has a valve function provided by the tube.

2. The straw according to claim 1, further comprising:

a coupling member provided at a lower portion of the straw body below the bellows portion and mounted to the top of the beverage container, thereby coupling the straw body to the beverage container; and a holding member mounted to a desired portion of the beverage container and adapted to hold an upper portion of the straw body above the bellows portion in the bent state of the bellows portion.

3. The straw according to claim 2, wherein the coupling member comprises a coupling member body, a coupling ring formed at an upper portion of the coupling member body and fitted around an outer surface of the straw body, and an annular coupling plate formed integrally with the coupling ring in such a fashion that it extends radially outwardly from a lower end of the coupling ring, the coupling plate being coupled to the top of the container.

4. The straw according to claim 2, wherein the holding member comprises a ring mounted to a desired portion of the beverage container and adapted to fit therein the upper portion of the straw body.

5. The straw according to claim 2, wherein the holding member comprises a fixing portion mounted to the beverage container, and a pair of spaced engagement hooks integrally formed with the fixing portion, the engagement hooks defining therebetween a gap, through which the upper portion of the straw body can be inserted, and engaging with the inserted portion of the straw body.

6. The straw according to claim 1, wherein the straw body has a circular or polygonal cross-sectional shape.

* * * * *